United States Patent [19]

Lundblade

[11] Patent Number: 4,742,851

[45] Date of Patent: May 10, 1988

[54] DRIPLESS FAUCET FOR BEVERAGE CONTAINERS

[75] Inventor: Gene D. Lundblade, Valley Center, Kans.

[73] Assignee: The Coleman Company, Inc., Wichita, Kans.

[21] Appl. No.: 886,337

[22] Filed: Jul. 17, 1986

[51] Int. Cl.[4] ..... B65D 3/00

[52] U.S. Cl. ..... 137/614.12; 137/614.18; 137/614.19; 137/628; 251/347; 251/353; 222/522

[58] Field of Search ..... 137/614.11, 614.12, 137/614.18, 614.19, 628; 251/341, 342, 343, 344, 347, 348, 349, 353; 222/92, 106, 522, 549, 553; 285/162

[56] References Cited

U.S. PATENT DOCUMENTS

| | | | |
|---|---|---|---|
| 1,825,568 | 9/1931 | Wray | 137/628 X |
| 2,638,108 | 6/1949 | Williams | 137/102 |
| 2,775,369 | 12/1956 | Waite | 222/522 X |
| 2,788,802 | 4/1957 | Vinson | 137/614.19 |
| 2,873,895 | 5/1957 | Dunn | 222/522 |
| 3,173,579 | 3/1965 | Curie | 222/105 |
| 3,223,117 | 3/1964 | Currie | 137/556.3 |
| 3,315,850 | 4/1967 | Gran | 222/501 |
| 3,430,824 | 2/1967 | Conners | 222/523 |
| 3,493,146 | 5/1967 | Conners | 222/153 |
| 4,351,455 | 9/1982 | Bond | 222/522 X |
| 4,440,316 | 4/1984 | Christine | 222/83.5 |
| 4,589,690 | 5/1986 | Muelmann | 285/162 |
| 4,621,750 | 11/1986 | Roethel | 251/347 X |

*Primary Examiner*—A. Michael Chambers
*Assistant Examiner*—John Fox

[57] ABSTRACT

A faucet for a liquid container includes a tubular housing which is mounted in an opening in the container and a tubular valve which is slidably mounted in the housing. The tubular housing includes open front and rear ends, and the valve extends forwardly from the front end of the housing. The valve includes a dispensing opening, and the valve is movable between a closed position in which the dispensing opening is positioned rearwardly of the front end of the housing and an open position in which the dispensing opening is positioned forwardly of the front end of the housing. A first seal is mounted on the front end of the valve forwardly of the dispensing opening for sealingly engaging the front end of the housing when the valve is closed, and a second seal is mounted on the rear end of the valve for sealingly engaging the housing as the valve is opened until the dispensing opening is at least partially open.

13 Claims, 3 Drawing Sheets

FIG. 5
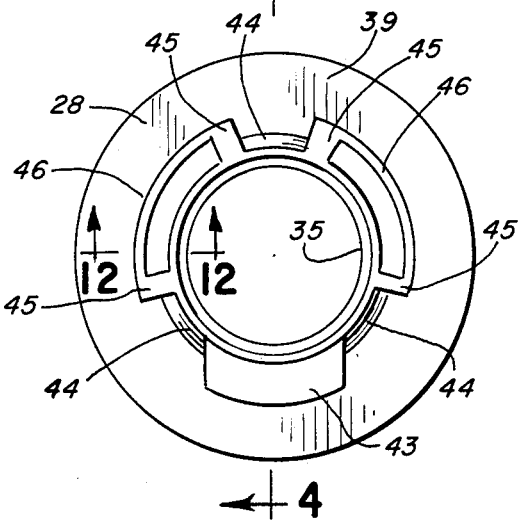
FIG. 4
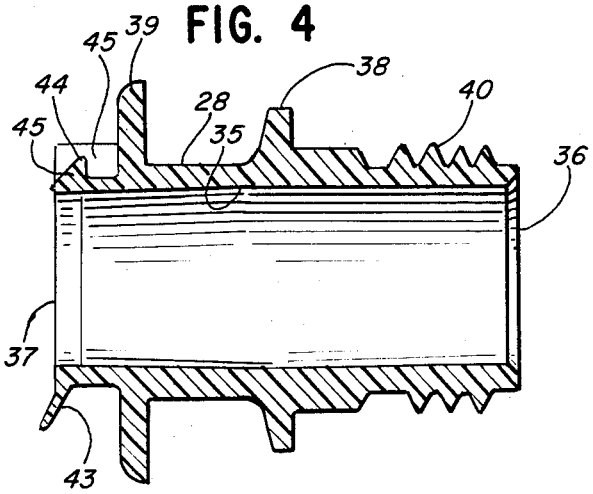
FIG. 7
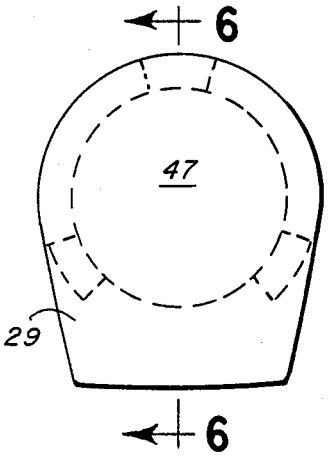
FIG. 6
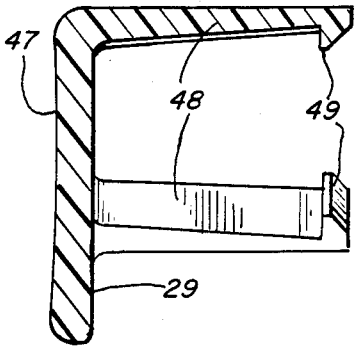
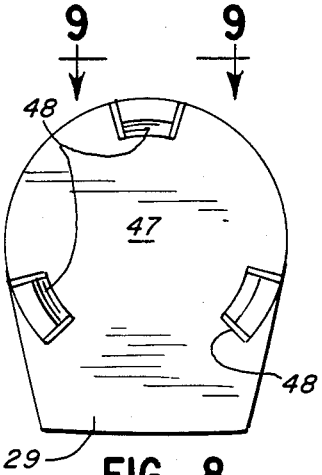
FIG. 8
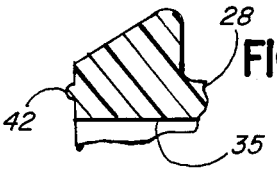
FIG. 10
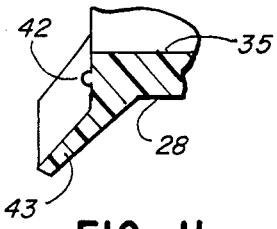
FIG. 11
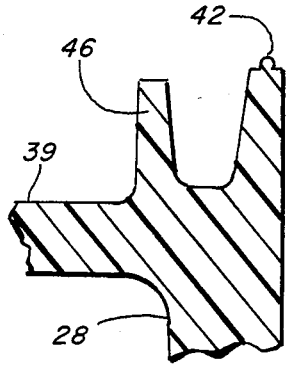
FIG. 12
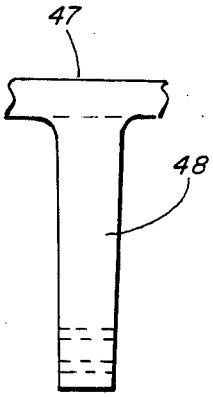
FIG. 9

FIG. 14
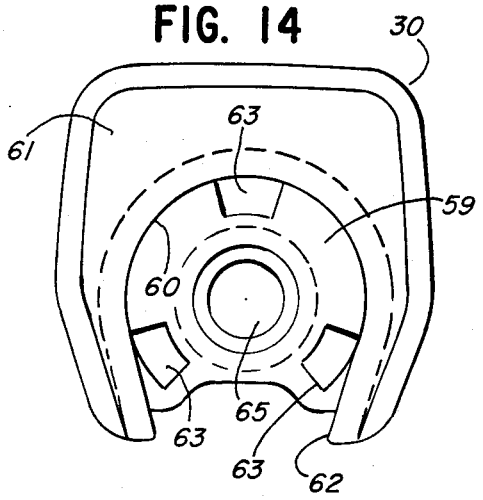
FIG. 13
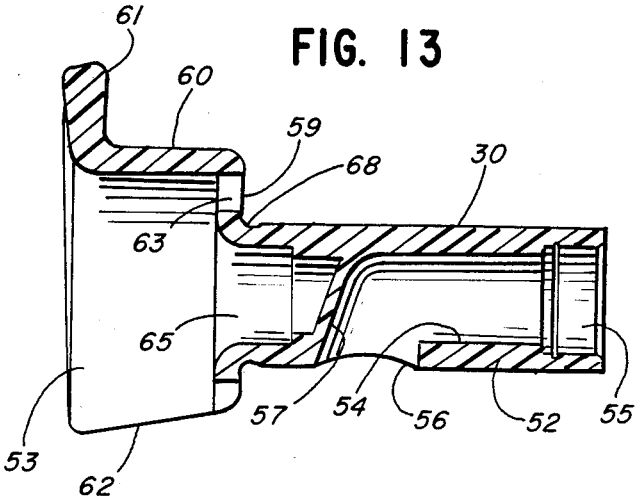
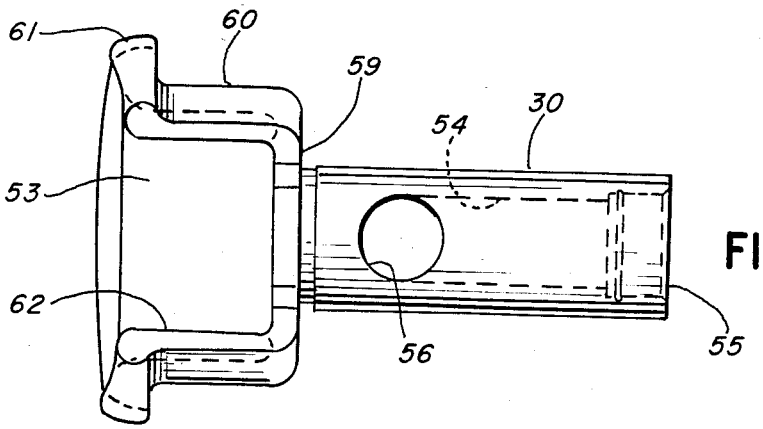
FIG. 15
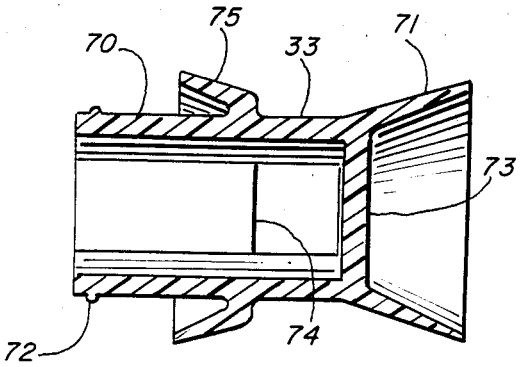
FIG. 16
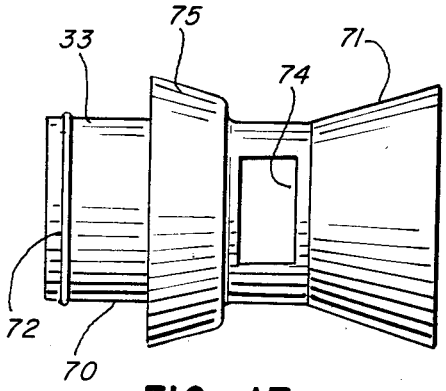
FIG. 17

DRIPLESS FAUCET FOR BEVERAGE CONTAINERS

BACKGROUND AND SUMMARY

This invention relates to a faucet for a beverage container and, more particularly, to a faucet which provides instant shut-off of liquid flow.

Beverage or liquid containers conventionally include a faucet or spigot for dispensing the liquid. It is desirable that the faucet stop dispensing the liquid at the instant the user wants it to stop. If liquid continues to drip from the faucet after it is turned off, liquid will drip from the faucet, stain the surface or other objects under the faucet, and generally cause a mess.

Many faucets have a shut-off gasket upstream of the dispensing opening. However, liquid which remains in such a faucet downstream of the gasket continues to dispense after the faucet is shut off.

The invention provides instant shut-off of liquid by providing a shut-off gasket or seal downstream of the dispensing opening in a reciprocating valve. The valve is slidably mounted in a tubular housing, and another seal on the upstream end of the valve sealingly engages the housing before the shut-off gasket engages the housing. When the shut-off gasket engages the housing, the dispensing opening of the valve is positioned within the housing. There are no passage ways of the valve which can drain after shut-off, and the flow of liquid is stopped instantly without subsequent dripping.

The valve can be operated easily by people with long fingernails and by people wearing gloves. The faucet includes a finger button which is mounted on the housing, and the valve includes a skirt which extends around a portion of the button. The skirt has a recess or open area, and the fingernail or glove tip can therefore extend beyond the button into the open area of the skirt.

DESCRIPTION OF THE DRAWING

The invention will be explained in conjunction with an illustrative embodiment shown in the accompanying drawing, in which

FIG. 4 is a longitudinal sectional view of the tubular housing of the faucet;

FIG. 5 is a front end view of the tubular housing of FIG. 4;

FIG. 6 is a longitudinal sectional view of the finger button of the faucet;

FIG. 7 is a front end view of the finger button of FIG. 6;

FIG. 8 is a rear end view of the finger button of FIG. 6;

FIG. 9 is a fragmentary top view of a portion of the finger button taken along the line 9—9 of FIG. 8;

FIG. 10 is an enlarged fragmentary sectional view of the upper forward portion of the tubular housing of FIG. 4;

FIG. 11 is an enlarged fragmentary sectional view of the lower forward end of the tubular housing of FIG. 4;

FIG. 12 is an enlarged fragmentary sectional view taken along the line 12—12 of FIG. 5;

FIG. 13 is a longitudinal sectional view of the valve of the faucet;

FIG. 14 is a front end view of the valve of FIG. 13;

FIG. 15 is a bottom view of the valve of FIG. 13;

FIG. 16 is a longitudinal sectional view of the rear sealing gasket of the faucet; and FIG. 17 is a side elevational view of the rear sealing gasket of FIG. 16.

DESCRIPTION OF SPECIFIC EMBODIMENT

Figure 1:
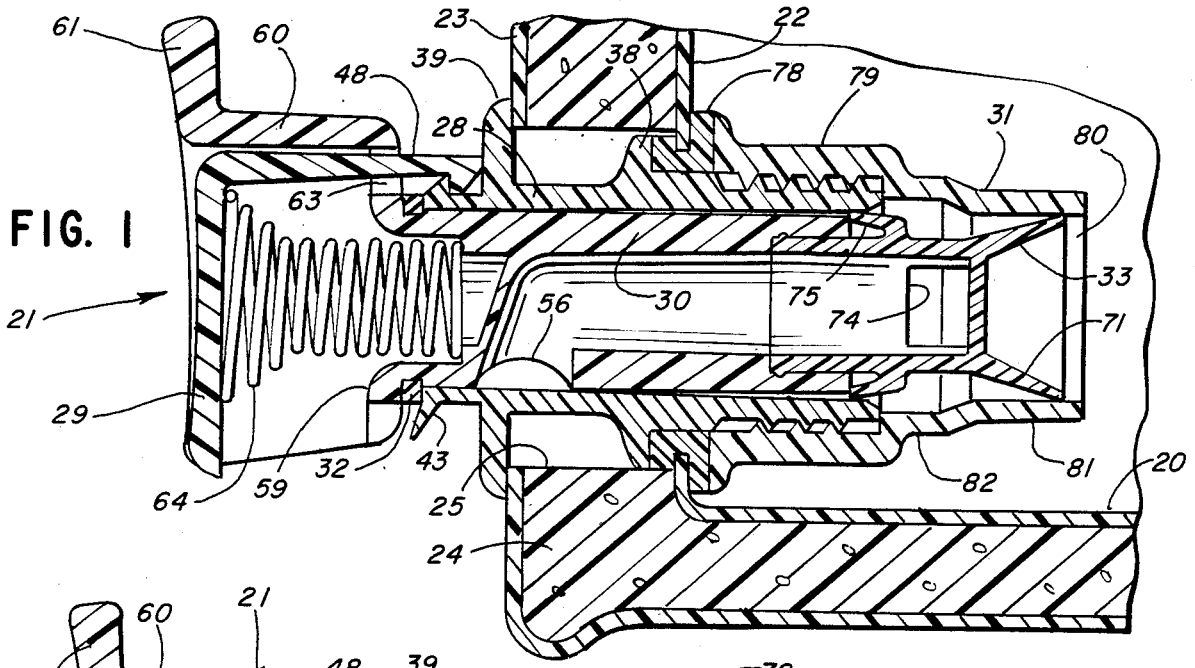
FIG. 1 is a fragmentary sectional view of a beverage container and a faucet formed in accordance with the invention, the faucet being shown in the closed position.
Figure 2:
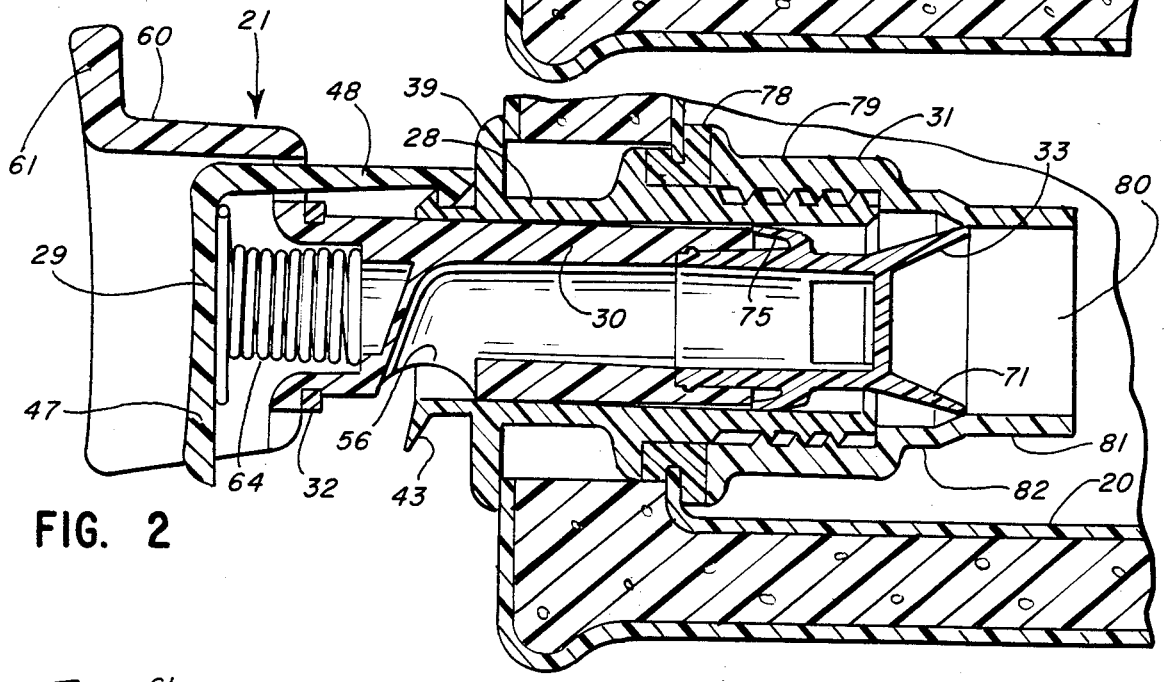
FIG. 2 is a view similar to FIG. 1 showing the faucet in a partially open position.
Figure 3:
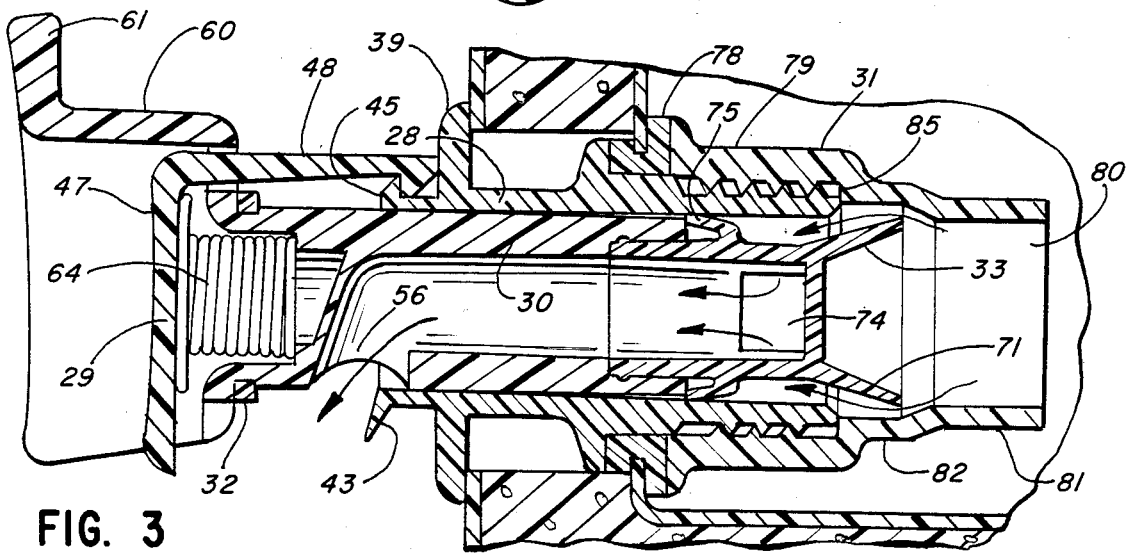
FIG. 3 is a view similar to FIGS. 1 and 2 showing the faucet in the open position.

Referring to FIGS. 1–3, a liquid container 20 is equipped with a faucet assembly 21 for dispensing liquid from the inside of the container. The container illustrated is a conventional beverage container or picnic jug which is sold by The Coleman Company, Inc. of Wichita, Kans. The container includes an inner plastic liner 22, an outer plastic shell or casing 23, and insulation 24 between the inner liner and the outer casing. The faucet assembly is mounted in an opening 25 which extends through the container adjacent the bottom thereof.

The faucet assembly includes a tubular housing 28 which is mounted in the opening in the container, a finger button 29 which is attached to the outer end of the housing 28, and a valve 30 which is slidably mounted in the housing. A nut 31 is screwed onto the inner end of the housing 28 and fixes the housing to the container 20. A front seal or gasket 32 is mounted on the valve 30 and sealingly engages the outer end of the tubular housing 28 when the valve is closed (FIG. 1), and a rear seal or gasket 33 is mounted on the rear end of the valve and sealingly engages the nut 31 when the valve is closed.

Referring now to FIGS. 4 and 5, the tubular housing 28 has a through bore 35, an open rear or inner end 36, an open front or outer end 37, and a pair of axially spaced radially outwardly extending flanges 38 and 39. The rear end of the housing includes external screw threads 40. An annular valve seat or rib 42 (see FIGS. 10 and 11) extends forwardly from the front end of the housing, and a spout 43 inclines downwardly and forwardly from the housing toward the bottom of the beverage container.

Three flanges 44 extend radially outwardly from the front end of the housing 28. The flanges are spaced 120° apart, and each flange includes a rearwardly inclined front camming surface 45 (FIG. 4). The flange 44 at 12 o'clock in FIG. 5 is bound by a pair of radially outwardly extending lugs 45, and the flanges 44 at 4 o'clock and 8 o'clock are each bound by a radially outwardly extending lug 45 and the spout 43. Adjacent lugs 45 are connected by an arcuate reinforcing wall 46.

The finger button 29 includes a flat front wall 47 (FIGS. 6–8) and three rearwardly extending attaching tabs 28 which are spaced 120° apart. Each attaching tab terminates in a lug 49 which has a rear camming surface, and each tab is secured behind one of the flanges 44 on the front end of the housing 48 and is secured against rotation about the axis of the housing by the lugs 45 and the spout 43.

The valve 30 includes a tubular body portion 52 (FIG. 13) which slides within the tubular housing 28 and a forward actuating portion 53. The tubular body 52 has an internal bore or fluid passage 54, an open rear end 55, and a dispensing opening 56 which opens toward the bottom of the beverage container. A partition 57 closes the forward end of the bore 54 and directs liquid to flow downwardly and forwardly through the dispensing opening.

The actuating portion 53 of the valve includes a radially outwardly extending wall 59, and axially extending arcuate wall or skirt 60, and a radially outwardly extending gripping flange 61.

The arcuate skirt 60 of the valve is sized to fit over the front wall 47 of the finger button 29, and the skirt 60 is provided with a recess or opening 62 at the lower portion thereof. The radially extending wall 59 is provided with three openings 63 through which the attaching tabs 48 of the finger button 29 extend. A coil spring 64 (FIGS. 1–3) extends into a counterbore 65 (FIG. 14) in the valve and is compressed between the valve and the finger button 29 to resiliently bias the valve to the closed position illustrated in FIG. 1.

The valve has an annular groove 68 (FIG. 13) behind the radially extending wall 59, and the front seal 32 (FIGS. 1–3) is mounted in the groove. The front seal 32 is an O-ring with flat front and rear surfaces, and the rear surface sealingly engages the annular seat 42 on the front end of the housing 28 when the valve is in the closed position.

The rear seal 33 (FIGS. 16 and 17) includes a generally cylindrical body portion 70 and an outwardly flared frusto-conical rear portion 71. The front end of the body portion of the seal 33 is inserted into the rear end of the valve 30, and a rib 72 on the body portion engages a groove in the valve to retain the body portion in the valve. A transverse partition 73 closes the rear end of the cylindrical body portion, and the wall of the body portion is provided with a pair of diametrically opposed openings 74 forwardly of the partition. A flared skirt 75 extends outwardly and forwardly from the body portion in front of the openings 74 and sealingly engages the tubular housing 28 at the rear end of the valve (see FIGS. 1–3).

Referring again to FIGS. 1–3, a grommet 78 having a generally U-shaped cross section is positioned in the opening in the inner liner 22 and is compressed between the nut 31 and the flange 38 on the tubular housing 28 to seal the opening in the liner. The nut 31 includes an internally threaded attaching portion 79 which is screwed onto the threads 40 of the tubular housing 28 to tighten the flanges 38 and 39 on the housing 28 against the grommet 78 and the outer casing 23, respectively. The outer surface of the attaching portion 79 is advantageously hexagonal in order to facilitate tightening the nut on the tubular housing.

The nut 31 includes a rear sealing portion 80 which has a first portion 81 with an inside diameter less than the maximum diameter of the frusto-conical rear portion 71 of the seal 33 and a second portion 82 with an inside diameter greater than the maximum diameter of the frusto-conical portion 71 of the seal. When the valve 30 is in the closed position illustrated in FIG. 1, the frusto-conical portion 71 of the seal 33 sealingly engages the small-diameter portion 81 of the nut. When the valve 30 is in the open position illustrated in FIG. 3, the frusto-conical portion 71 of the seal 31 is positioned within the larger diameter portion 82 of the nut and is spaced from the inside surface thereof.

The rear seal 33 is advantageously molded from polyethylene, the front seal 32 is advantageously formed from 55 durometer nitrile, and the grommet 78 is advantageously formed from polyolefin T.P.E. Shore A55. The tubular housing 28, finger button 29, valve 30, and nut 31 are advantageously molded from plastic. In one specific embodiment the tubular housing, valve, and nut were molded from polypropylene and the finger button was molded from acetal.

The faucet is assembled by mounting the grommet 78 in the opening in the inner liner of the beverage container, inserting the tubular housing 28 through the opening, and screwing the nut 31 on the inner end of the housing 28. The valve 30 with the seals 32 and 33 is inserted into the bore of the housing 28, the spring 64 is positioned in the counterbore 65 of the valve 30, and the attaching tabs 48 of the finger button 29 are inserted through the openings 63 in the valve and secured by the flanges 44 on the housing 28.

Operation

FIG. 1 illustrates the faucet assembly when the valve 30 is closed. The rear seal 33 sealingly engages the small-diameter portion 81 of the nut 31, and the front seal 32 sealingly engages the seat 42 on the front end of the tubular housing 28. A person can open the valve 30 by pressing a finger, for example, a thumb, against the flat wall 47 of the finger button 29, grasping the flange 61 on the front end of the valve with other fingers, and pulling the valve 30 forwardly. The attaching tabs 48 of the finger button 29 guide movement of the valve and maintain the valve substantially coaxial with the tubular housing 28.

FIG. 2 shows the valve 30 slightly forwardly of its closed position and the dispensing opening 56 partially open. The front seal 32 is withdrawn from the forward of the tubular housing 28, but liquid is prevented from dispensing through the faucet because rear seal 33 is still in contact with the small-diameter portion 81 of the nut 31. If liquid is allowed to dispense in this position of the valve for two gallon or larger containers, the liquid flow pattern from the dispensing opening will be erratic and will change directions depending upon the amount of the dispensing opening which is exposed beyond the front end of the tubular housing 28. The rear seal 33 therefore prevents liquid flow until enough of the dispensing opening is exposed to provide good flow characteristics.

FIG. 3 shows the valve 30 in the open and dispensing position. The rear seal 33 is forward of the small-diameter portion 81 of the nut 31, and liquid can flow from the container around the frusto-conical portion 71 of the seal 33, through the openings 74 in the seal, through the fluid passage in the valve 30, and through the dispensing opening 56. The rear seal 33 has two sealing portions—71 and 75. The sealing portion 71 prevents liquid flow through the valve until a sufficient amount of the dispensing opening is exposed. The sealing portion 75 prevents liquid from escaping between the outer surface of the valve 30 and the inner surface of the tubular housing 28 when the faucet is dispensing liquids. The longitudinal dimensional relationship between the small-diameter portion 81 and the sealing portion 71 of the rear seal 33 which prevents liquid flow until the dispensing opening is opened sufficiently is controlled by an internal shoulder 85 (FIG. 3) on the nut which engages the rear end of the tubular housing 28.

The faucet is closed simply by releasing the valve 30. The spring 64 moves the valves rearwardly toward its FIG. 1 position. Liquid flow out of the container is stopped as the rear seal 33 engages the small-diameter portion 81 of the nut 31. However, liquid within the internal bore of the valve can still drain through the dispensing opening until the front seal 32 engages the seat 42 on the front end of the housing 28. When the front seal engages the housing, liquid flow is instantly shut off. The front seal 32 is downstream of the dispensing opening 56, and the dispensing opening 56 is positioned within the tubular housing 28 and is sealed by the front seal 32. There are therefore no passages which can drain when the front seal engages the housing 28.

The spout 43 at the bottom of the seal 32 acts as a liquid flow controller during sealing of the faucet. The flow controller 43 directs liquid away from the bottom outside surface of the liquid container when the faucet is released suddenly to stop liquid flow. If the valve moves sufficiently fast, the tail end of the liquid stream which flows through the dispensing opening 56 will contact the seal 32, and liquid will be thrown from the rapidly moving seal toward the flow controller 43. The liquid then falls from the flow controller 43 to the drinking container below the faucet. If there was no flow controller, the liquid would be thrown from the gasket to the bottom outside surface of the liquid container.

The faucet not only provides instant and dripless shut-off, but the faucet can be easily operated by persons with long fingernails and persons wearing gloves. The skirt 60 on the front end of the valve which curves around the finger button 29 does not extend around the bottom of the finger button. The recess or opening at the bottom of the skirt allows a persons fingernail or the tip of a glove to extend beyond the bottom of the finger button 29 without contacting the valve and interfering with the opening of the valve. The diameter of the flat wall 47 of the finger button 29 is about one inch. This large diameter easily accommodates a gloved thumb, and the actuating portion of the valve which is formed by the skirt 60 and the flange 61 is large enough to accommodate two gloved fingers for opening the valve.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A faucet for a liquid container comprising:

a tubular housing adapted to be mounted in an opening in the container, the tubular housing having an open rear end adapted to be positioned within the container and an open front end adapted to be positioned outside of the container, a tubular valve slidably mounted within the tubular housing, the valve having a rear end, a front end, and a dispensing opening adjacent the front end, the valve being movable between a closed position in which the dispensing opening is positioned rearwardly of the open front end of the housing and an open position in which the dispensing opening is positioned forwardly of the open front end of the housing, and a first seal mounted on the valve forwardly of the dispensing opening and sealingly engaging the forward end of the housing when the valve is in the close dposition whereby flow of liquid through the valve is shut off when the seal engages the housing and, a second seal mounted on the rear end of the valve and sealingly engaging the housing when the valve is in its closed position, and the spacing between the first and second seals is such that the first seal moves out of sealing engagement with the housing before the second seal as the valve moves from the closed positon to the open position.

2. The faucet of claim 1 in which the housing includes a rear end portion having a first portion with a diameter less than the diameter of the second seal and a second portion forwardly of the first portion with a diameter greater than the diameter of the second seal whereby liquid can flow past the second seal when the second seal is in the second portion of the housing.

3. The faucet of claim 1 in which the second seal includes a generally cylindrical body having a central bore and at least one side opening and a frusto-conical rear end portion which flares outwardly from the body portion for sealingly engaging the rear end portion of the housing.

4. The faucet of claim 1 in which the second seal further includes a radially outwardly extending intermediate portion which sealingly engages the housing adjacent the rear end of the valve.

5. The faucet of claim 1 in which the front end of the housing includes an annular sealing portion and the first seal is an O-ring which surrounds the valve and is engageable with the annular sealing portion.

6. The faucet of claim 5 in which the housing includes liquid flow controlling portion which extends downwardly from the front end of the housing in axial alignment with the dispensing opening.

7. The faucet of claim 1 in which the housing includes a tubular body portion which has an externally threaded end and a nut portion which is threadedly engaged with the externally threaded rear end and which is adapted to provide a seal between the housing and the inside of the container.

8. The faucet of claim 7 including a second seal mounted on the rear end of the valve and sealingly engaging the housing when the valve is in the closed position, the nut including an internal wall having a first portion with a diameter less than the diameter of the second seal and a second portion forwardly of the first portion with a diameter greater than the diameter of the second seal whereby liquid can flow past the second seal when the second seal is in the second portion of the internal wall of the nut.

9. The faucet of claim 7 including a gasket adapted to be mounted in the opening of the container and having front and rear surfaces, the body portion of the housing including a first radially outwardly extending flange adapted to engage the outside of the container and a second radially outwardly extending flange rearwardly of the first flange and engaging the front surface of the gasket, the nut engaging the rear surface of the gasket.

10. A faucet for a liquid container comprising:

a tubular housing adapted to be mounted in an opening in the container, the tubular housing having an open rear end adapted to be positioned within the container and an open front end adapted to be positioned outside of the container, a tubular valve slidably mounted within the tubular housing, the valve having a rear end, a front end, and a dispensing opening adjacent the front end, the valve being movable between a closed position in which the dispensing opening is positioned rearwardly of the open front end of the housing and an open position in which the dispensing opening is positioned forwardly of the open front end of the housing, and a seal mounted on the valve forwardly of the dispensing opening and sealingly engaging the forward end of the housing when the valve is in the closed position whereby flow of liquid through the valve is shut off when the seal engages the housing, and a finger button mounted on the front end of the housing and extending forwardly therefrom, the valve extending forwardly beyond the finger button and terminating in a forward actuating portion whereby the valve can be opened by engaging the finger button with a finger and pulling the actuating portion of the valve forwardly including a spring between the finger button and the valve for resiliently biasing the valve to the closed position.

11. The faucet of claim 10 in which the finger button includes a forward surface which extends generally transversely to the axis of the valve and a plurality of axially extending attaching portions which are attached to the housing, the actuating portion of the valve including a radially ourwardly extending portion which is provided with openings through which the attaching portions of the finger button extend.

12. The faucet of claim 10 in which the actuating portion of the valve includes an axially extending skirt which extends fowardly from the radially outwardly extending portion of the actuating portion and which is provided with a recess at the bottom of the finger button.

13. The faucet of claim 10 in which the actuating portion of the valve includes a flange which extends radially outwardly from the axially extending skirt of the actuating portion.

* * * * *